United States Patent [19]

Kelly

[11] 4,322,024

[45] Mar. 30, 1982

[54] FOOD CARRYING BELT

[75] Inventor: Thomas J. Kelly, London, England

[73] Assignee: Woolston-Kelly Survival Limited, London, England

[21] Appl. No.: 36,868

[22] Filed: May 7, 1979

[51] Int. Cl.[3] ..... A45F 3/00

[52] U.S. Cl. ..... 224/224; 224/235

[58] Field of Search ..... 224/222, 224, 228, 229, 224/230, 235, 237; 229/56; 426/118, 119, 120, 121, 122, 123, 124

[56] References Cited

U.S. PATENT DOCUMENTS

| | | | |
|---|---|---|---|
| 1,486,470 | 3/1924 | Welch | 224/224 |
| 2,596,884 | 5/1952 | Bailen | 224/224 X |
| 3,162,539 | 12/1964 | Repko | 426/119 |
| 3,190,513 | 6/1965 | Wheeler | 224/224 |
| 3,346,154 | 10/1967 | Bishop | 224/184 |
| 3,429,718 | 2/1969 | Helms | 229/56 X |
| 3,830,944 | 8/1974 | Dimitriadis | 426/124 X |
| 4,051,266 | 9/1977 | Goltsos | 426/120 |
| 4,176,772 | 12/1979 | Danon | 224/148 |

FOREIGN PATENT DOCUMENTS

| | | | |
|---|---|---|---|
| 238070 | 9/1945 | Switzerland | 224/224 |
| 311136 | 5/1929 | United Kingdom | 224/226 |

*Primary Examiner*—Robert J. Spar
*Assistant Examiner*—Fred A. Silverberg
*Attorney, Agent, or Firm*—Salter & Michaelson

[57] ABSTRACT

A ration belt which may be worn around the waist or as a bandolier comprises an elongate sleeve of flexible plastics material such as PVC transversely sealed at locations along the sleeve to provide sealed pouches containing 24-hour one-man foodstuffs rations. The plastics sleeve can be clipped directly to the webbing harness or carried in a separate pouch.

5 Claims, 2 Drawing Figures

FOOD CARRYING BELT

FOOD CARRYING BELT

This invention relates to means for carrying foodstuffs.

It is necessary in a variety of situations, military and otherwise, for individuals to carry a day or more's rations on the person. An object of the present invention is to provide means for the carriage of rations on the person which represent an improvement over ration packs used hitherto in that they are more convenient to carry and better suited to bulk distribution.

According to the present invention there is provided a ration belt comprising an elongate sleeve of flexible plastics material transversely sealed at locations along the sleeve to provide sealed pouches containing foodstuffs, the sleeve having at opposite ends thereof respective fastening means which are complementarily cooperable enabling the belt to be secured on the person so that it encircles the torso.

In another aspect, the present invention consists in a ration belt comprising a strap having at opposite ends thereof fastening means enabling the belt to be secured around the person and an elongate sleeve of flexible plastics material transversely sealed at locations along the sleeve to provide sealed pouches containing foodstuffs, said sleeve being releasably carried longitudinally upon said strap so as at least partially to encircle the torso.

Figure 1:
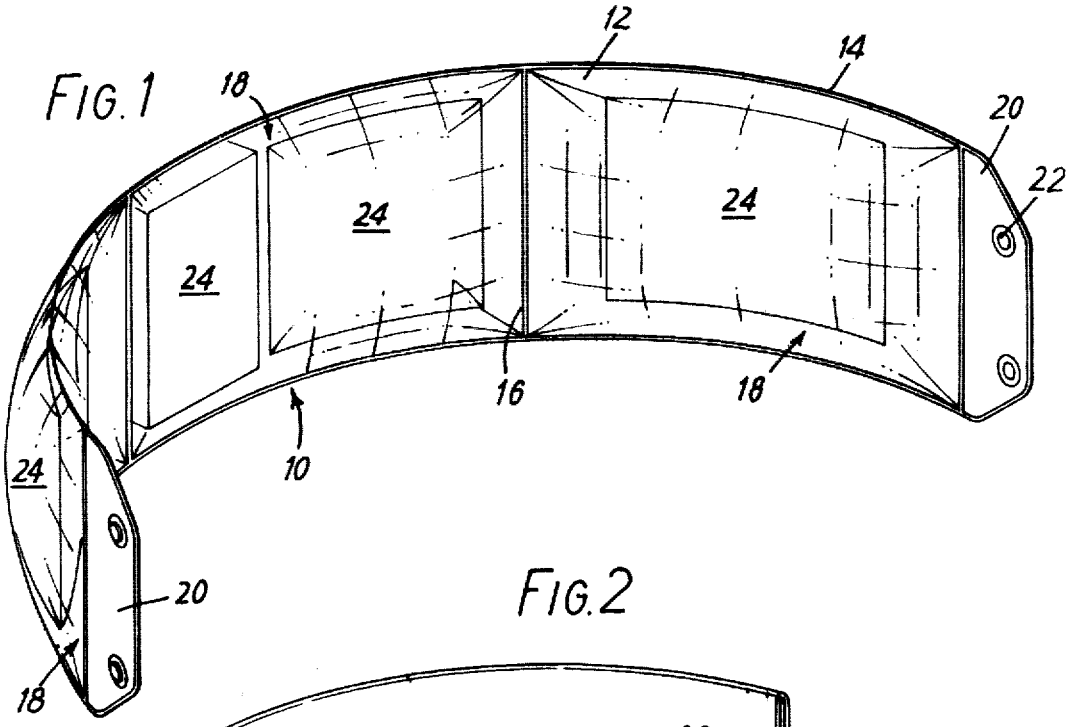
Figure 2:
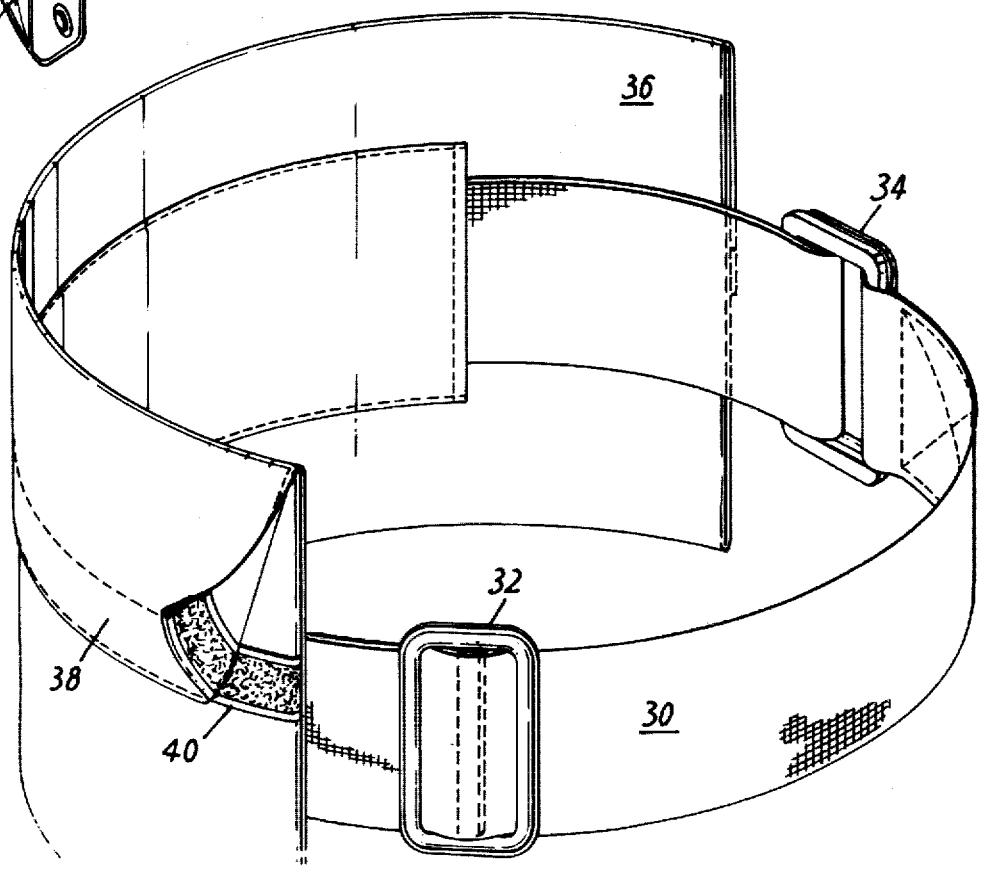

The invention will now be described by way of example with reference to the accompanying drawings in which:

FIG. 1 is a sketch of a plastics sleeve containing foodstuffs and providing a belt according to one embodiment of the invention, and FIG. 2 is a sketch of a strap and pouch arrangement cooperable in another embodiment with the sleeve shown in FIG. 1 to provide a belt according to this invention.

The plastics sleeve shown generally at 10 comprises two PVC walls 12 which are welded at a longitudinal welds 14 and transverse welds 16 to provide three sealed pouches 18. Tabs 20 are formed integrally at opposite ends of the sleeve and each carry a pair of reinforced eyelets 22 the purpose of which will be described more fully hereinafter. The PVC walls 12 are preferably of not more than 500 gauge and one at least of these walls is preferably transparent.

In a preferred example, the foodstuffs 24 carried in the three sealed pouches 18 represent a 24 hour emergency food supply for one person. The food supply will typically provide 4000 calories and will be made up of such items as dehydrated meals, cereal, coffee, sugar, soup, milk powder and chocolate.

The belt shown in FIG. 1 is primarily designed to be secured to the webbing harness which typically forms part of the uniform worn by military personnel. The belt is carried around the waist preferably to the rear and clips of generally known form are pushed through the reinforced eyelets 22 to engage with corresponding eyelets in the webbing harness. In an alternative, the plastics sleeve of FIG. 1 can be used in conjunction with the pouch and strap assembly shown in FIG. 2.

Referring to FIG. 2 a webbing strap 30 is provided with a length adjusting device 32 and a fastening in the form of cooperating buckles 34. A fabric pouch 36 is slidably mounted on the strap 30 and is provided outwardly of the strap with a flap closure 38 carrying one element of a burr fastener 40, the other element of which is stitched to the outer wall of the pouch. As will be appreciated, the sleeve shown in FIG. 1 is inserted in the pouch 36 and the resulting belt 30 can be carried either around the waist or as a bandolier.

In a preferred method of manufacture, the foodstuffs items which are to be carried in the belt are positioned between sheets of PVC prior to the simultaneous formation by welding of the longitudinal and transverse seams. This operation will be facilitated if those items which are to be contained in a single pouch of the finished belt are first assembled, as for example with a plastics overwrapping, to form a single package which can be handled more easily that the individual items. In an alternative method of manufacture, the individual foodstuffs items, or preferably three packages made up therefrom, are positioned at suitable intervals along a preformed plastics sleeve prior to formation of transverse welds 16 and end tabs 20. Other methods of manufacture and indeed other suitable plastics materials will occur to those skilled in the art.

Advantageously, the sealed pouches 18 are arranged to enclose a sufficient volume on air to provide the belt with positive buoyancy. In this way the belt will assist in keeping the wearer afloat if he is in danger of drowning. Particularly, the belt can be removed from the waist and wrapped around the wearer's neck to maintain the head above water level.

As the described belt is both light-weight and flexible it lends itself readily to bulk distribution and large numbers of the belts can be packed in containers for rapid distribution in the field. In the case where a plastics sleeve is used in connection with a pouch and strap arrangement, the pouch and strap arrangement will generally be reusable.

It should be understood that this invention has been described by way of example only and numerous modifications are possible without departing from the scope of the invention. For instance, whilst FIG. 1 shows a belt which in use will only partially encircle the torso of the wearer, it will be possible with a somewhat lengthened sleeve to replace the eyelets 22 on the two end tabs 20 with respective complementary halves of a belt coupling such as a snap action fastener. In this way the belt can be worn either around the waist or as a bandolier to completely encircle the torso.

What is claimed is:

1. A belt for carrying rations therein and for securement on the torso of a user, comprising an elongated sleeve of flexible plastic material, said sleeve being permanently sealed along the longitudinal edges thereof and being transversely sealed along the length thereof in spaced relation to define at least three air impervious pouches that must be ruptured to gain access thereto, each of said pouches receiving packages of foodstuffs therein, wherein said foodstuffs are retained in relatively fresh condition in said pouches, and fastening means secured to the opposite edges of said sleeve for securing said belt at least partially around the torso of said user.

2. A belt as claimed in claim 1, an elongated webbing strap, said elongated sleeve of flexible plastic material being releasably mounted on said strap, means on said strap for enclosing said sleeve, and fastening means associated with said strap for securing said strap and sleeve mounted thereon in encircling relation on the torso of said user.

3. A belt as claimed in claim 1, said air impervious pouches forming a buoyant assembly that is usable in assisting the user in maintaining flotation when immersed in water.

4. A belt as claimed in claim 1, said flexible plastic material being of PVC sheet material.

5. A belt as claimed in claim 4, said flexible plastic sleeve being composed of two PVC sheets which are sealed along the longitudinal edges thereof.

* * * * *